United States Patent [19]

Kashio

[11] 4,184,320

[45] Jan. 22, 1980

[54] ELECTRONIC STOP WATCHES

[75] Inventor: Toshio Kashio, Tokyo, Japan

[73] Assignee: Casio Computer Co., Ltd., Tokyo, Japan

[21] Appl. No.: 893,785

[22] Filed: Apr. 5, 1978

Related U.S. Application Data

[63] Continuation of Ser. No. 689,804, May 25, 1976, abandoned.

[30] Foreign Application Priority Data

May 30, 1975 [JP] Japan ..... 50-65121

[51] Int. Cl.[2] ..... G04F 7/04

[52] U.S. Cl. ..... 58/74; 58/50 R; 58/23 R; 58/39.5

[58] Field of Search ..... 58/50 R, 74, 23 R, 85.5, 58/39.5

[56] References Cited

U.S. PATENT DOCUMENTS

| | | | |
|---|---|---|---|
| 3,672,155 | 6/1972 | Bergey et al. | 58/50 R |
| 3,788,058 | 1/1974 | Idei et al. | 58/50 R X |
| 3,789,600 | 2/1974 | Champan | 58/74 X |
| 3,795,099 | 3/1974 | Tsuruishi | 58/74 |
| 3,854,277 | 12/1974 | Samejima et al. | 58/74 X |
| 3,940,920 | 3/1976 | Nakamura et al. | 58/50 R X |
| 3,991,552 | 11/1976 | Ho et al. | 58/50 R X |

OTHER PUBLICATIONS

"CT6004-CMOS Digital Watch Circuit" Cal Tex Semiconductor, Inc., P.O. Box 2808, Santa Clara, CA, 95051, Jul. 24, 1974.

*Primary Examiner*—Ulysses Weldon

*Attorney, Agent, or Firm*—Frishauf, Holtz, Goodman & Woodward

[57] ABSTRACT

An electronic stop watch includes a time counter circuit starting to count reference clock pulses in response to a starting signal and a digital display arrangement having a predetermined number of display sections to display the time counted or measured by the time counter circuit.

A specified count detection circuit is provided to detect that a count of the time counter circuit has reached a specified value which can be displayed by the display sections of the display arrangement. A detection output signal from the detection circuit serves as a display changeover command signal to control count signals which are supplied from the time counter circuit to the display arrangement so that the display arrangement can display time, according to the count of the time counter circuit, in large units of time, for example, in "hours and minutes", instead of small units of time, for example, in "minutes and seconds", after a detection signal has been produced from the detection circuit.

14 Claims, 4 Drawing Figures

ELECTRONIC STOP WATCHES

This is a continuation of application Ser. No. 689,804, filed May 25, 1976, now abandoned.

This invention relates to a stop watch capable of displaying time counts belonging to different time categories and connecting of a limited number of digits in the form of a specified value in a plurality of display sections comprising the same number of display segments.

In the field of electronic stop watches, a digital display watch in which time counting operation can be electronically effected and the time is digitally displayed has been markedly developed. In particular, use of liquid crystal, light emitting diodes (LED), etc. as a display means has accelerated the development of a small-sized electronic stop watch including a wrist watch which can provide a digital display. The range of the time measured by the electronic stop watch is often required to include a generally long time counting range in which time is measured or counted, for example, in terms of "hours-minutes" as well as a relatively short time counting range in which time is measured, for example, in terms of "minutes-seconds".

It is generally desired that the time counting accuracy of a timepiece including a stop watch should be sufficiently high in any time range. It may be clearly understood, however, that it is important in the short time counting range to precisely count or measure time in "seconds" but it is not highly required in the long time counting range to measure time in "seconds" with high precision. With the prior art time piece apparatus in which time is measured in "seconds", "minutes" and "hours", count representative of time in "seconds" is displayed in any time counting range. Even when only a time display of "hours" or "hours and minutes" is required, display of "seconds" has been carried to the excess, and can be regarded as a wasteful process.

This invention is based on the fact that display of "seconds" must be effected in a time range in which "minutes and seconds" are counted but is not indispensable in a time range in which "hours" or "hours and minutes" are counted. In this invention, a detection signal is produced as a changeover command signal, when the specified time count is obtained, to change the units of time so that the time counted in a suitable unit can be digitally displayed by a display arrangement having a predetermined number of time display sections.

It is technically advantageous in the following points to display the counted time in a different unit of time on the same display sections described above. That is, with a small-sized digital timepiece such as a wrist watch including a stop watch, the area of the display sections or the size of display segments for displaying numerals are limited so that the numerals displayed must be made extremely small where "hours" and "minutes" are respectively displayed by two-digit numerals and "second" is displayed on the same display panel, making it troublesome to read the displayed time. This can be easily solved by displaying the counted time in the same display sections but with a different unit of time. Thus, according to this invention, "hours", "minutes" and "seconds" can be readily read in spite of the limitation on the area of the display panel.

As is clearly understood from the above description, an object of this invention is to provide an electronic stop watch in which the counted time is selectively displayed in different units of time in the same digit positions of a display arrangement having a predetermined number of display sections as display of "seconds" can be eliminated in the time counting operation required for displaying only "hours" or "hours and minutes".

SUMMARY OF THE INVENTION

According to an aspect of this invention, there is provided an electronic stop watch which comprises a time counter circuit for counting a clock pulse to effect a time counting operation, a display arrangement having a predetermined number of display sections to display the time counted by the time counter circuit, a detection circuit for detecting that a time count of the time counter circuit has reached a specified time count which can be displayed by the display arrangement and a circuit responding to a detection signal produced from the detection circuit to change a time count expressed in first units of time of the time counter circuit into a time count expressed in second units of time which are larger than the first units of time.

According to this invention, units of time can be changed so as to be suitable for the display of the time counted and the time counted in different units of time can be displayed in the same display sections which are provided in number corresponding to display time digits. Further, the time which is counted in terms of "hours", "minutes" and "seconds" can be suitably displayed in spite of the limitation on the area of the display arrangement.

DETAILED DESCRIPTION

Figure 1:
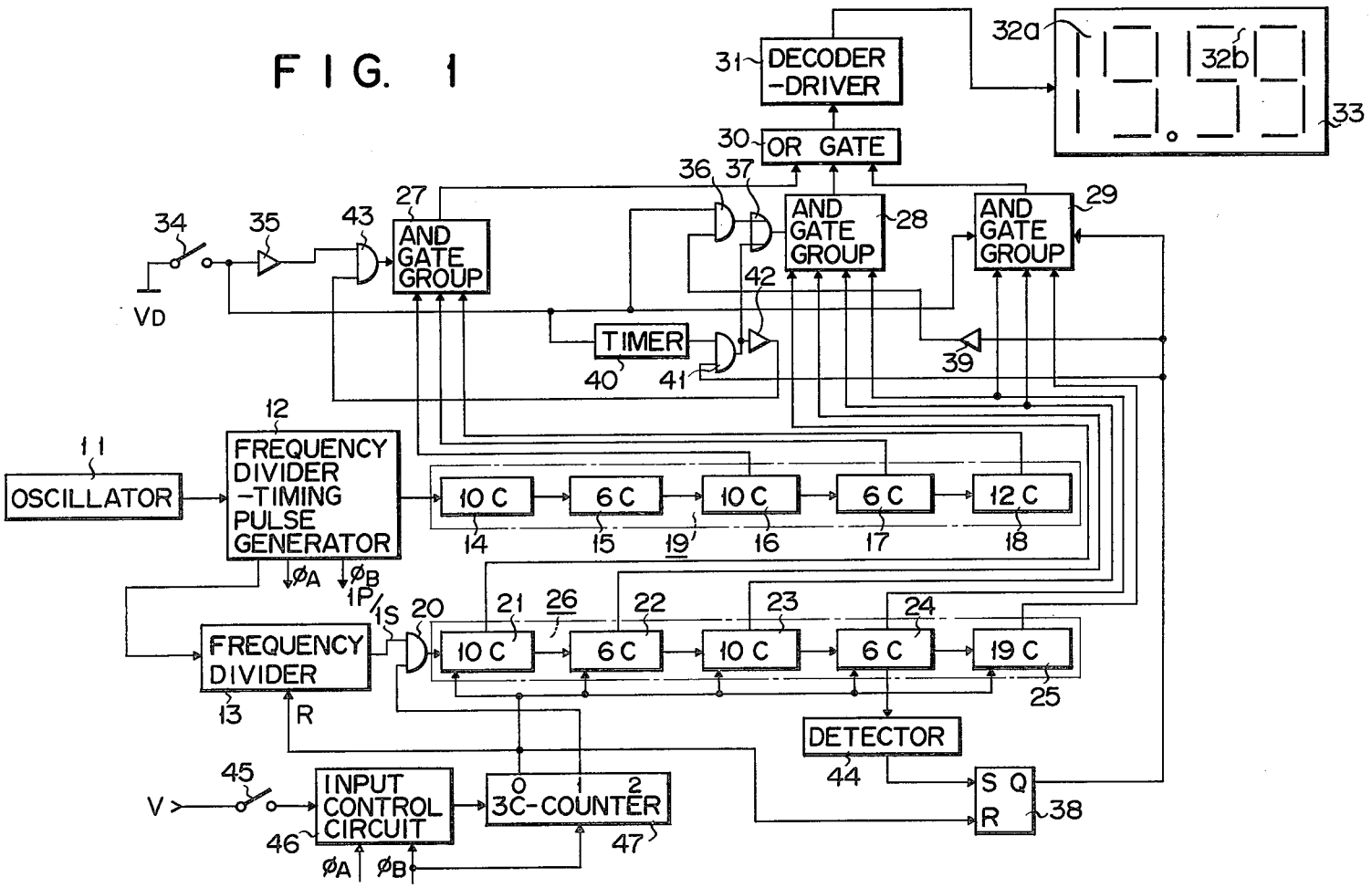
FIG. 1 is a block circuit diagram of a timepiece which has, in addition to a usual time counting function, a time counting function of an electronic stop watch according to one embodiment of this invention.
Figure 4:
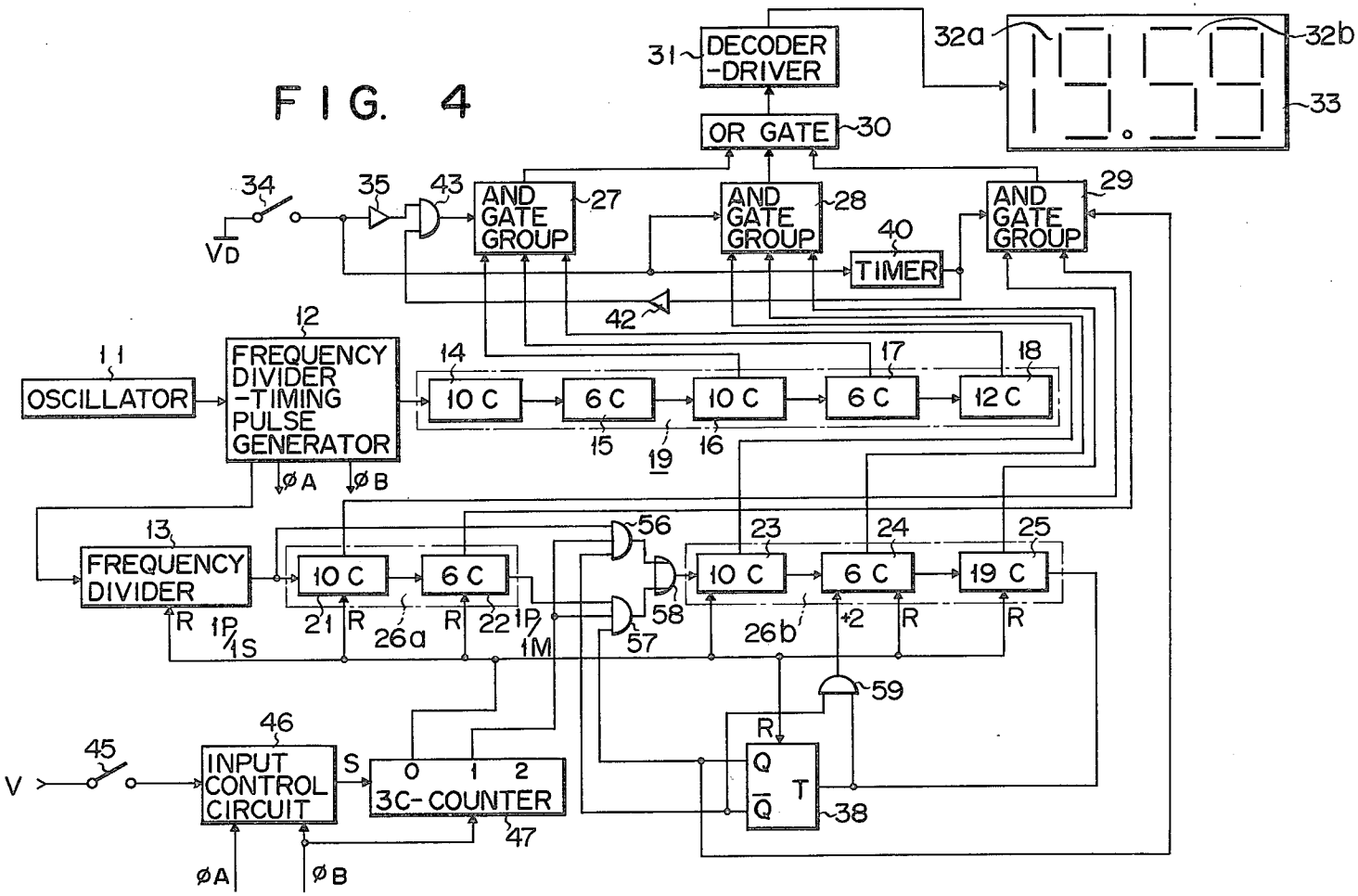
FIG. 4 is a block circuit diagram used for explaining a further embodiment of this invention.

FIGS. 1 and 4 show embodiments in which the time counting functions of an ordinary timepiece and a stop watch are combined. However, it is, of course, possible to provide an embodiment in the form of a simple stop watch.

Referring now to FIG. 1, a reference clock signal produced from an oscillator 11 is supplied to frequency dividers 12 to generate a time counting signal of one pulse per second (1P/s). The frequency divider 12 also functions as a timing circuit and produces, in addition to the signal of 1P/s, a clock signal to the frequency divider 13 and clock pulses $\phi A$ and $\phi B$ used for controlling other circuits. The frequency divider 13 produces a time counting signal (1P/s) upon receipt of the clock signal from the frequency divider 12. While receiving a reset signal as will be described later, the frequency divider 13 is maintained in a reset state and produces no output signal, and when the reset signal terminates it starts to count a signal from the oscillator 11 and produces an output signal.

The time counting signal (1P/s) from the frequency divider 12 is supplied as a step command signal to a 10-scale counter 14. To the 10-scale counter 14, 6-scale, 10-scale, 6-scale and 12-scale counters 15, 16, 17 and 18 are cascade connected in this order and the counters are sequentially stepped by a carry signal. That is, the counters 14 and 15 function to count "seconds", the counters 16 and 17 "minutes", and the counter 18 "hours". The counters 14 to 18 combine to constitute a time counter circuit 19 which performs an ordinary time counting operation. An output signal from the frequency divider 13 is supplied to a time counter circuit 26 which is constituted by 10-scale, 6-scale, 10-scale, 6-scale and 19-scale counters 21, 22, 23, 24 and 25 cascade connected to perform a stop watch function. The counters 21 and 22 function to count "seconds", the counters 23 and 24 count "minutes" and the counter 25 counts "hours" in response to the output signal from the frequency divider 13.

Time counting signals from the counters 16 to 18 corresponding to the "minute" and "hour" counters of the time counter circuit 19 are supplied to a first AND gate group 27, time counting signals from the counters 21 to 24 corresponding to the "second" and "minute" counters of the time counter circuit 26 are supplied to a second AND gate group 28, and time counting signals from the counters 23 to 25 corresponding to the "minute" and "hour" counters of the time counter circuit 26 are fed to a third AND gate group 29. Output signals of the AND gate groups 27 to 29 are supplied to an OR gate circuit 30 whose output signal is applied to a decoder driver 31 to drive a digital display arrangement 33 having two-digit numeral display sections 32*a* and 32*b* which display the high and low digit numerals, respectively.

The AND gate groups 27 to 29 are controlled by a switch 34 which is operated when it is required to display a time count of the stop watch time counter circuit 26 in place of a time count of the ordinary time counter circuit 19. The operator of the switch 34 causes an inverter 35 connected to the switch 34 to supply a gate signal to the first AND gate group 27. At the same time, the signal from the switch 34 closed is supplied as a gate signal to the second AND gate group 28 through an AND circuit 36 and OR circuit 37. The third AND gate group 29 opens its gates when it receives both the signal from the switch 34 closed and an output signal from a flip-flop circuit 38 set which will be described later. The set terminal of the flip-flop circuit 38 is also connected to an inverter 39 whose output signal is supplied to the AND circuit 36 as a gate signal. A timer 40 is provided which is set when the switch 34 is opened and continues to produce an output signal for a prescribed period of time from the opening of the switch 34. The output signal from the timer 40 is supplied to an AND circuit 41 together with the set output signal of the flip-flop circuit 38, causing the AND circuit 41 to produce an output signal to the OR circuit 37. The output terminal of the AND circuit 41 is also connected to an inverter 42 whose output signal is applied as a gate signal at one input terminal of the AND circuit 43 which receives an output signal of the inverter 35 at the other input terminal. The AND circuit 43 produces an output signal to the first AND gate group 27 to open the gate of the AND gate group 27. The flip-flop circuit 38 is set by a detection signal produced from a detector 44 which is connected to detect that the counter 24 counting the higher digit numeral of the "minute" digit of the time counter circuit 26 displays a count of "2".

In this timepiece apparatus, a switch 45 is provided which is closed by, for example, depressing a push button (not shown) when it is required to use the timepiece as a stop watch. When operated, the switch 45 supplies a pulse signal to an input control circuit 46, that is, a single pulse is applied to the input control circuit 46 wherever the switch 45 is operated. A pulse signal produced from the input control circuit 46 is supplied as a step signal to a control counter 47 to produce a count output signal corresponding to its count of "0", "1" or "2". the "0" count output signal from the control counter 47 is applied as a reset signal to the frequency divider 13, counters 21 to 25 and flip-flop circuit 38, and the "1" count output signal is supplied as a gate signal to the AND circuit 20 at one input terminal.

Figure 2:
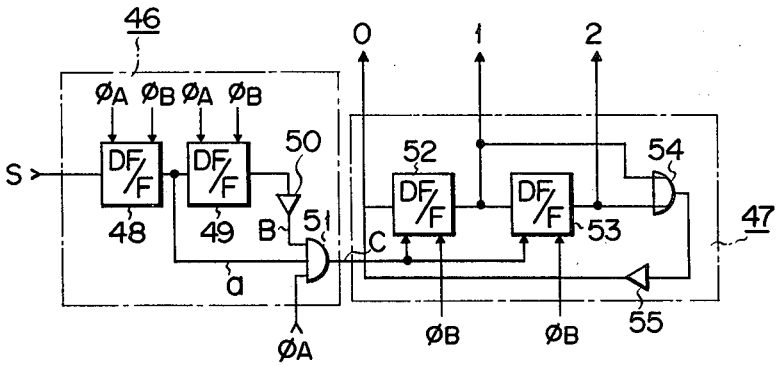
FIG. 2 is a detailed circuit diagram of an input control circuit and a control counter used in the embodiment of FIG. 1.

FIG. 2 shows the input control circuit 46 and control counter 47 in more detail. A signal S generated upon operation of the switch 45 is sequentially supplied to delay circuits 48 and 49 each formed of a delayed flip-flop circuit and is written into the delay circuit under a control of a clock pulse $\phi$A and read out therefrom in response to a clock pulse $\phi$B. An output signal of the delay circuit 48 and a signal produced from the delay circuit 49 through an inverter 50 are applied as gate signals to an AND circuit 51 which also receives a clock pulse $\phi$A.

Figure 3:
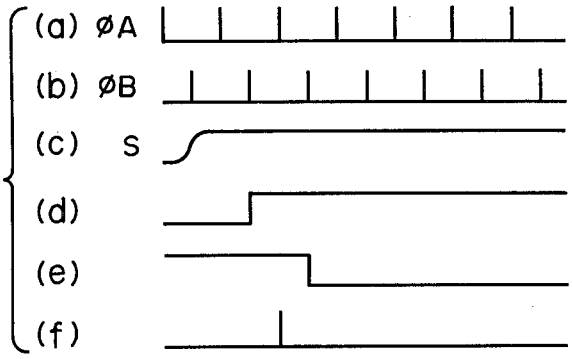
FIG. 3 shows signal waveforms utilized to explain the control operation of the control counter.

Assume now that the clock pulses $\phi$A and $\phi$B are generated in a manner of different input timings as shown in FIGS. 3(*a*) and (*b*) and the switch 45 is operated to provide a signal S. Then, the delay circuit 48 and inverter 50 produce output signals as shown in FIGS. 3(*d*) and (*e*) so that, as shown in FIG. 3(*f*), a single pulse signal is produced from the AND circuit 51 in accordance with the clock pulse $\phi$A.

The control counter 47 is constituted by serially connected delay circuits 52 and 53 which are set in a write-in state by the clock pulse $\phi$A and in a readout state in response to the clock pulse $\phi$B. Output signals of the delay circuits 52 and 53 are supplied to an OR gate 54 whose output terminal is connected to an inverter 55. An output signal of the inverter 55 is fed back to the delay circuit 52 and is derived out as a "0" count output signal. On the other hand, the output signals of the delay circuits 52 and 53 are derived out as "1" and "2" count output signals, respectively. That is, a single pulse output signal is generated from the input control circuit 46 in response to the clock pulse $\phi$A each time the switch 45 is operated and the delay circuits 52 and 53 of the control counter 47 are sequentially set in the output states of "0, 0", "1, 0" and "0, 1" in response to a pulse signal from the AND circuit 51 so that the count signals of "0", "1" and "2" can be sequentially derived out.

In the timepiece apparatus described above, the time counter circuit 19 functions to always divide the frequency of a reference clock pulse from the oscillator 11 and count the reference clock pulse so as to perform a time counting operation. In this case, the switch 34 is set in a open state and both inverters 35 and 42 produce output signals so that a gate signal is applied to the AND gate group 27 through the AND circuit 43 and accordingly time counting signals from the time counter circuit 19 are supplied to the decoder driver 31 through the OR gate group 30. Thus, the time is digitally displayed in terms of "hours and minutes" by the display sections 31*a* and 32*b* of the display arrangement 33.

In order to permit the timepiece apparatus to function as a stop watch and to display the counted time, the switch 45 is operated to generate a start command signal for time counting operation and the switch 34 is operated, if required. In the original state, the control counter 47 is set to produce a "0" count signal and the frequency divider 13, time counter circuit 26 and flip-flop circuit 38 are reset. Upon operation of the switch 45, the control counter 47 produces a "1" count signal and the frequency divider 13 and time counter circuit 26 are released from the reset state, thereby opening the gate of the AND circuit 20 to start the time counting operation. In this case, the switch 34 is maintained at a closed position to supply a signal to the AND circuit 36 at one input terminal and the flip-flop circuit 38 is reset to cause the inverter 39 to produce an output signal to the AND circuit 36 at the other input terminal, so that a gate signal is supplied from the AND circuit 36 to the second AND gate group 28 through the OR circuit 37. Thus, the time of the stop watch is displayed in the unit of "minutes and seconds" by the display sections 32*a* and 32*b*.

As described before, in the case of using the timepiece apparatus as a stop watch, it is often unnecessary to display time in seconds where the time is counted in terms of "hours and minutes". In this embodiment, a specified time count is selected and the units of the counted time displayed by the display arrangement having a predetermined number of display digit positions are changed when the specified time count is reached. As shown in FIG. 1, in this embodiment, the specified time count is selected to be "19 minutes, 59 seconds". Therefore, the time is counted and displayed in "minutes and seconds" on the two-digit display sections 32*a* and 32*b* of the display arrangement 33 until the time count of "19 minutes, 59 seconds" is reached. Then, when the time of "20 minutes, 0 second" is counted the units of the time displayed on the display sections 32*a* and 32*b* change from "minutes and seconds" to "hours and minutes" and the counted time of "0 hour, 20 minutes" is displayed.

That is, a count of "2" in the 6-scale counter 24 of the time counter circuit 26 is detected by the detector 44 whose output signal is supplied to the flip-flop circuit 38 to set the same. The set output signal of the flip-flop circuit 38 closes the gate of the AND circuit 36 through the inverter 38 so that the second AND gate group 28 is prevented from producing an output signal, and at the same time the gates of the third AND gate group 29 are opened, permitting "hour and minute" count signals from the counters 23, 24 and 25 to be supplied to the display arrangement 33 through the OR gate 30 and decoder driver 30. Thus, the time is displayed as "0 hour, 20 minutes" following the time count of "12 minutes, 59 seconds" and can be further counted to "19 hours, 20 minutes" at its maximum.

The time counting operation is continued until the next operation of the switch 45 is effected. The second operation of the switch 45 causes the control counter 47 to produce a "2" count signal, closing the gate of the AND circuit 20. That is, the second operation of the switch 45 causes a stop command signal to be produced and the time corresponding to a period of time from the first operation to the second operation of the switch 45 is measured.

In the high order time digit displaying operation, opening of the display control switch 34 causes the gates of the third AND gate group 29 to be closed and the second AND gate group 28 is supplied with a gate signal from the AND circuit 41 through the OR circuit 37 for a length of time set by the timer 40, permitting the lower digit of the measured time to be displayed by the display arrangement 33. Then, after the lapse of the length of time set by the timer 40, the gates of the first AND gate group 27 are opened so that time signals can again be supplied from the time counter circuit 19 to the display arrangement 33 to provide an ordinary time display.

In the embodiment discribed above, in order to change units of the time to be displayed, the counters 21 to 25 are selectively operated to derive out a time signal representative of the time displayed by the display arrangement 33. However, it is also possible to supply a time signal in different units of time to the same counters so as to display a time count in different units of time which is supplied to the display arrangement 33.

That is, as shown in FIG. 4, first and second time counter circuits 26*a* and 26*b* are constituted by counters 21 and 22 and counters 23, 24 and 25, respectively, and count signals from the counters 23, 24 and 25 are supplied to the second AND gate group 28 and count signals from the counters 21 and 22 are supplied to the third AND gate group 29. An output signal from the frequency divider 13 is supplied to the counter 21 and an AND circuit 56 and a carry signal produced from the counter 22 is applied to an AND circuit 57. Output signals from the AND circuit 56 and 57 are fed as a step signal to the counter 23 through an OR circuit 58. The AND circuits 56 and 57 each receive a gate signal at one input terminal when the control counter 47 has a count of "1", and the AND circuits 56 and 59 are supplied with a gate signal when the flip-flop circuit 38 is reset. At this time, the flip-flop circuit 38 is triggered by a carry signal from the counter 25. The AND circuit 59 receiving the trigger signal and an output signal from the flip-flop circuit 38 set produces an output signal to the counter 24 as a "+2" set command signal to preset the same. Operation of the switch 34 causes the second AND gate group 28 to receive a gate signal and an output signal from the timer 40 is supplied as a gate signal to the third AND gate group 29. Other circuit portions in FIG. 4 similar to those in FIG. 1 are denoted by the same reference numerals and are not explained here.

In the timepiece apparatus shown in FIG. 4, the control counter 47 has a "0" count in the initial condition and the flip-flop circuit 38 is reset. When it is required to use the timepiece apparatus as a stop watch, the switch 45 is operated to produce a signal S, causing the control counter 47 to have a "1" count. then, the frequency divider 13 starts a frequency dividing operation to produce an output signal which is counted by the first time counter circuit 26*a*. At the same time, the gate of the AND circuit 56 is opened so that the second time counter circuit 26*b* performs a time counting operation as well as the first time counter circuit 26*a*, measuring the time in the unit of "minutes and seconds" by the counters 23, 24 and 25.

Assuming that the switch 34 is turned on prior to the operation of the switch 45, a time signal produced when the time counter circuit 26*b* starts the time counting operation is supplied to the decoder driver 31 through the second AND gate group 28, permitting the display arrangement 33 to display the measured time in terms of "minutes and seconds". This time measuring operation is continued, and when the count corresponding to "19 minutes, 59 seconds" is reached the counter 25 produces a carry signal to trigger and set the flip-flop circuit 38. At this time, the AND circuit 59 produces an output signal in response to the carry signal to set into the "2" count state the counter 24 which has been set to have a count "0" since the generation of the carry signal. In this case, the counters 21, 22, 23 and 25 are all set in a "0" count state, and when the flip-flop circuit 56 is set the gate of the AND circuit 56 is closed and the gate of the AND circuit 57 is opened. As a result, the counters 21 and 22 and the counters 23, 24 and 25 are cascade connected through the AND circuit 57 and then the counters 23, 24 and 25 function to count the time in terms of "minutes" and "hours" and the display of the display arrangement 33 changes from "19 minutes, 59 seconds" to "0 hour, 20 minutes". thus, the time measured by the stop watch is displayed in terms of "hours and minutes". That is, the time is displayed by the display arrangement 33 in the same manner as the first embodiment or in such a manner that the unit of the time displayed is changed when the specified time count is reached.

The timer 40 produces an output signal for a prescribed length of time from the operation of the switch 34 and opens the gates of the third AND gate group 29 so that time count of the counters 21 and 22 for the lower digit or "second" digit can be displayed. Then, after the lapse of a prescribed length of time set by the timer 40, the gates of the first AND gate group 27 are opened to resume the ordinary time counting operation and display the time in the display arrangement 33.

In this embodiment, the display arrangement 33 is designed for the ordinary time display. However, the display arrangement may be designed for a stop watch display where the timepiece apparatus has only a stop watch function. Further, since the timepiece apparatus is designed mainly for performing an ordinary time counting operation and the display section 32*a* is not required to display a count more than "1" in its ten-digit position, the specified count is selected to be "19 minutes, 59 seconds". However, where the timepiece apparatus is used mainly for a stop watch, the display section 32*a* can be designed to display a count of more than "1" and the specified count can be set to be "59 minutes, 59 seconds".

The time counter circuit 26 is formed of 10-scale and 6-scale counters to count the time on the basis of 60-scale, but it is possible to constitute the time counter circuit by a single 10-scale counter so as to count the time on the basis of 10-scale.

Further, the upper limit of the display count is set to be "19.59", but, owing to the difference in the units of time, it is not clear that the count should be read as "19 minutes, 59 seconds" or "19 hours, 59 minutes". To make a clear distinction between them, for example, a lamp is provided which is lit by an output signal of the flip-flop circuit 38 set when the detector detects the specified time count. When the lamp is lit, it is clearly seen that the display arrangement displays the time in the unit of "hours and minutes".

In the embodiment, the timepiece apparatus, it usually used as an ordinary timepiece, and when required it can be changed to function as a stop watch by operating the switches 34 and 45 to provide a time display of the stop watch. By detecting, however, that the timepiece apparatus has just been changed into stop watch operation, or in the embodiment shown in FIG. 1, by detecting a count "1" or "2" or the control counter 47, the time measured by the stop watch can automatically be displayed in specified units of time in place of the time display for the ordinary timepiece, and when a specified time count is obtained the time of the stop watch is displayed in larger units of time.

The single switch 45 is used to control the time counting operation of the stop watch and is operated to sequentially start, stop and reset the stop watch function. However, it is possible to perform a start operation after the stop operation by use of the control counter 47 or provision of another switch. Moreover, "second" is used as a fundamental unit of time in the embodiment, but is is possible to use, for example, "0.01 second" as a fundamental unit of time to measure time of less than a second. This invention can obviously be practiced with various modifications without departing from the object and scope of the invention.

What is claimed is:

1. An electronic stopwatch comprising:

means for generating reference clock pulses;

means for supplying a time count start instruction to start operation of the stopwatch function of the stopwatch;

time counting means coupled to said generating means and to said supplying means and adapted to start to count the reference clock pulses in response to a given time count start instruction from said supplying means, said time counting means including a plurality of time counting units for counting time in different units of time, said different units of time including at least small units of time and large units of time which are larger than said small units of time, said time counting means counting time in the smallest units of the time first and the largest units of time last;

digital display means coupled to said time counting means and having a restricted number of display digits capable of displaying only some, but not all, of said different units of time, said display digits being supplied by said time counting means with count values in said small units of time responsive to generation of said given time count start instruction;

detection means coupled to said time counting means for detecting that the count value in said small units of time in said time counting means has reached a predetermined count value which can be displayed by said digital display means after generation of said given time count start instruction and for generating a detection signal responsive to said detection; and changeover means coupled to said detection means for automatically causing said display digits of said display means to display the cumulative count value from the initial time count start instruction in said large units of time instead of the count value in said small units of time, in response to a detection signal from said detection means thereby continuing to display the cumulative time being counted by the stopwatch from the initial time count start instruction.

2. An electronic stopwatch according to claim 1, wherein said time counting means comprises at least first and second counting circuits, said first counting circuit counting time in said small units of time and second counting circuit counting time in said large units, said second counting circuit receiving a carry from said first counting circuit when the count value of said first counting circuit reaches a predetermined count; and there are further provided means for coupling said first counting circuit to the display digits of said digital display means responsive to generation of said time count start instruction; and means for coupling said second counting circuit to the display digits of said digital display means instead of said first counting circuit, in response to a detection signal from said detection means.

3. An electronic stopwatch according to claim 1, wherein said detection means comprises a decoder circuit for detecting that the count value of said time counting means has reached said predetermined count value, said predetermined count value being "19 minutes 59 seconds".

4. An electronic stopwatch according to claim 1, wherein said time counting means further includes a time counting circuit for counting the reference clock pulses so as to supply a normal time counting signal to said digital display means.

5. An electronic stopwatch according to claim 4, further comprising:

manually operable switch means for alternately coupling the contents of said time counting circuit and the contents of said time counting means to said digital display means;

means for coupling the count value in said small units of time of said time counting means to the display digits of said digital display means when said manually operable switch means is first operated; said count value in said large units of time of said time counting means being displayed by the display digits of said digital display means, instead of the count value in said small units of time, in response to said detection signal from said detection means operating said changeover means; and means for coupling the count value in said small units of time of said time counting means to the display digits of said digital display means, instead of the count value in said large units of time, when said manually operable switch means is operated again.

6. An electronic stopwatch according to claim 5, further comprising:

a timer for driving said last-mentioned coupling means for a predetermined period of time; and means for coupling the contents of said time counting circuit to said digital display means, instead of the count value in small units of time of said time counting means upon elapse of said predetermined period of time.

7. An electronic stopwatch according to claim 1, wherein said time counting means comprises a counting circuit for obtaining a count value in said small units of time to be coupled to said digital display means after said time count start instruction has been generated; and means coupled to said counting circuit for causing, in response to a detection signal from said detection means, said counting circuit to count time in said large units.

8. An electronic stopwatch according to claim 7, further comprising:

first means for coupling specified clock pulses obtained by frequency-dividing said reference clock pulses to said counting circuit for counting in said small units of time after said time count start instruction has been generated; and second means for coupling clock pulses of a low frequency from a pulse counter circuit for counting said specified clock pulses to said counting circuit, instead of said specified clock pulses, for counting in said large units of time in response to a detection signal from said detection means, said low frequency being lower than the frequency of said specified clock pulses.

9. An electronic stopwatch comprising:

means for generating reference clock pulses;

means for supplying a time count start instruction;

a second-counting circuit coupled to said generating means and to said supplying means and adapted to start to count the reference clock pulses in response to said time count start instruction;

a minute-counting circuit coupled to said second-counting circuit and adapted to count carry signals from said second-counting circuit;

an hour-counting circuit coupled to said minute-counting circuit and adapted to count carry signals from said minute-counting circuit;

digital display means having a restricted number of display digits;

first means for coupling the count values of said minute- and second-counting circuits to the display digits of said digital display means responsive to generation of said time count start instruction;

detection means coupled to said minute- and second-counting circuits for detecting that the count value of said minute- and second-counting circuits has reached a predetermined count value which can be displayed by said digital display means after generation of said time count start instruction and for generating a detection signal responsive to said detection; and second means for coupling the count values of said hour- and minute-counting circuits to the display digits of said digital display means, instead of the count values of said minute- and second-counting circuits, in response to the detection signal from said detection means.

10. An electronic stopwatch according to claim 9, wherein said detection means comprises a decoder circuit for detecting that the count value of said time counting means has reached said predetermined count value, said predetermined count value being "19 minutes 59 seconds".

11. An electronic stopwatch according to claim 9, wherein said time counting means further includes a time counting circuit for counting the reference clock pulses so as to supply a normal time counting signal to said digital display means.

12. An electronic stopwatch comprising:

means for generating reference clock pulses;

means for supplying a time count start instruction;

time counting means coupled to said generating means and to said supplying means and adapted to start to count the reference clock pulses in response to said timecount start instruction, said time counting means including at least second-, minute- and hour-counting circuits;

digital display means coupled to said time counting means and having a restricted number of display digits capable of displaying time only in the units of second, minute and hour, said display digits being supplied with the count values from the second-, minute- and hour-counting circuits of said time counting means in response to said time count start instruction;

detection means coupled to said time counting means for detecting that the count value of the second- and minute-counting circuits of said time counting means has reached a predetermined value which can be displayed by said digital display means after generation of said time count start instruction and for generating a detection signal responsive to said detection; and changeover means coupled to said detection means for automatically causing said display digits of said display means to display the count values of the minute- and hour-counting circuits of said time counting means, instead of the count values of the second- and minute-counting circuits of said time counting means, in response to the detection signal from said detection means.

13. An electronic stopwatch according to claim 12, wherein said detection means comprises a decoder circuit for detecting that the count value of said time counting means has reached said predetermined count value, said predetermined count value being "19 minutes 59 seconds".

14. An electronic stopwatch according to claim 12, wherein said time counting means further includes a time counting circuit for counting the reference clock pulses so as to supply a normal time counting signal to said digital display means.

* * * * *